US007178299B2

(12) United States Patent
Hyde et al.

(10) Patent No.: US 7,178,299 B2
(45) Date of Patent: Feb. 20, 2007

(54) TILES WITH EMBEDDED LOCATING RODS FOR EROSION RESISTANT LININGS

(75) Inventors: Dean R Hyde, Southampton Hampshire (GB); Robert L. Antram, Warrenton, VA (US); Dean R Peterson, Ashburn, VA (US)

(73) Assignee: ExxonMobil Research and Engineering Company, Annandale, NY (US)

( * ) Notice: Subject to any disclaimer, the term of this patent is extended or adjusted under 35 U.S.C. 154(b) by 225 days.

(21) Appl. No.: 10/439,968

(22) Filed: May 16, 2003

(65) Prior Publication Data

US 2004/0226251 A1 Nov. 18, 2004

(51) Int. Cl.
*E04F 13/07* (2006.01)

(52) U.S. Cl. ..... 52/388; 52/391; 52/390; 52/384; 52/337; 428/44; 428/48

(58) Field of Classification Search ..... 52/378, 52/379, 334, 385, 387, 388, 386, 600, 389, 52/384, 383, 391, 392, 390, 337; 110/338, 110/340, 339, 336
See application file for complete search history.

(56) References Cited

U.S. PATENT DOCUMENTS

| | | | | | |
|---|---|---|---|---|---|
| 191,383 | A | * | 5/1877 | Stuart | 292/37 |
| 298,889 | A | * | 5/1884 | Pritchard | 292/37 |
| 488,961 | A | * | 12/1892 | Brintnall | 292/35 |
| 822,562 | A | * | 6/1906 | Tucker | 292/37 |
| 956,759 | A | * | 5/1910 | Clouse | 292/37 |
| 1,534,341 | A | * | 4/1925 | Bernotow | 96/148 |
| 2,074,874 | A | * | 3/1937 | Werner | 110/336 |
| 2,096,963 | A | * | 10/1937 | Erman | 52/389 |
| 2,122,696 | A | * | 7/1938 | Poston | 52/389 |
| 2,337,156 | A | * | 12/1943 | Elmendorf | 52/391 |
| 2,413,183 | A | * | 12/1946 | Hosbein | 52/506.04 |
| 3,106,751 | A | * | 10/1963 | Fish | 52/309.5 |
| 3,362,740 | A | * | 1/1968 | Burns | 292/34 |
| 3,953,061 | A | * | 4/1976 | Hansen et al. | 292/5 |
| 4,073,243 | A | | 2/1978 | Merkle, Jr. | |
| 4,117,201 | A | | 9/1978 | Keifert | |
| 4,122,642 | A | * | 10/1978 | Buchy | 52/511 |
| 4,137,681 | A | | 2/1979 | Pasley | |
| 4,176,505 | A | * | 12/1979 | Fischer | 52/578 |
| 4,333,406 | A | * | 6/1982 | Duke | 110/340 |
| 4,344,753 | A | * | 8/1982 | Shelley et al. | 432/3 |
| 4,651,487 | A | * | 3/1987 | Nishikawa | 52/378 |
| 4,680,010 | A | * | 7/1987 | Ginzburg et al. | 432/148 |

(Continued)

FOREIGN PATENT DOCUMENTS

| | | | | |
|---|---|---|---|---|
| EP | 180553 | * | 7/1986 | 110/336 |

(Continued)

*Primary Examiner*—Phi Dieu Tran A
(74) *Attorney, Agent, or Firm*—Glenn T. Barrett

(57) ABSTRACT

A tile for lining an internal surface in a heavy wear area. The tile includes at least one locating rod embedded within said tile and an internal mechanism for laterally extending said at least one locating rod out of said tile and into a gap in an adjoining structure which may be another tile. The tiles forming the lining surface are securely held in place as a result of the selective deployment of the locating rods into a gap in the adjoining structure.

12 Claims, 12 Drawing Sheets

U.S. PATENT DOCUMENTS 4,680,908 A * 7/1987 Crowley ..... 52/378
4,753,053 A 6/1988 Heard
4,768,447 A * 9/1988 Roumeguere ..... 110/325
4,934,116 A * 6/1990 Frederiksen ..... 52/220.3
5,058,937 A * 10/1991 Miehe et al. ..... 292/34
5,438,813 A 8/1995 Wade
5,542,218 A * 8/1996 Rompel ..... 52/34
5,586,795 A * 12/1996 Sasaki ..... 292/336.3
5,673,527 A * 10/1997 Coston et al. ..... 52/506.02
5,957,067 A * 9/1999 Dobbeling et al. ..... 110/336
6,044,805 A 4/2000 Walker et al.
6,129,967 A 10/2000 Young et al.
6,393,789 B1 * 5/2002 Lanclos ..... 52/378
6,397,765 B1 * 6/2002 Becker ..... 110/336
6,782,669 B1 * 8/2004 Dixon ..... 52/506.02
6,887,551 B2 * 5/2005 Hyde et al. ..... 428/99

FOREIGN PATENT DOCUMENTS

JP 5-157224 * 6/1993 ..... 110/336
WO WO 92/09850 * 6/1992 ..... 110/336
WO WO 97/09577 3/1997
WO WO 00/68615 11/2000

* cited by examiner

TILES WITH EMBEDDED LOCATING RODS FOR EROSION RESISTANT LININGS

FIELD OF THE INVENTION

The present invention relates generally to ceramic linings for walls of reactors subject to high temperatures and more particularly to anchoring systems for tiles which are used to form such ceramic linings.

BACKGROUND OF THE INVENTION

Refinery process units, such as fluid catalytic cracking units, and other reactors and furnace-like equipment require, by their very nature, heat, wear and chemical resistant linings along portions of their interiors. The present art of ramming monolithic refractories into hexagonal-shaped metal mesh is well known.

Common practices in the field are to line reactors with hexagonal mesh (FIGS. 1–3) into which a refractory monolithic material is rammed while in a plastic, malleable state. Reactions in such materials, with or without the application of heat, cause a hardening of the material resulting in a lining in the wear areas capable of withstanding the environment encountered. In contrast to malleable state materials, it has long been known that pre-formed ceramic materials are more resistant to wear, erosion, and corrosion conditions than monolithic refractories. Ceramic tiles, though resistant to extreme conditions, are relatively brittle. As such they must be mounted to a reactor substrate lining with care. Mounting them gently, however, often impedes how securely the tiles are affixed to the lining. Prior art has resulted in tiles that are unreliable and which fail due to thermal cycling and other stresses which occur in service.

FIGS. 1, 2 and 3 illustrate the current practice of using malleable, non-preformed materials and injecting them into mesh. Referring to these figures, it can be seen that hexagonal mesh (Hexmetal) 10, which is typically ¾ to 1" thick, is formed from metal strips 101 bent to form half-hexagonal shapes which are connected by clinches 102 punched from the metal strips 101 and bent over to secure two strips 101 together to form the hexagonal cells. Mesh 101 is preferably welded to substrate 302 via weld 215. Tabs 103 may be punched from metal strips 101 and help to secure the monolithic refractory into the cells after hardening. After filling of the cells, the monolithic refractory hardens by use of a setting agent or by application of heat to form a wear- and corrosion-resistance lining.

To the extent that any pre-formed tiles are used, tabs 103 may be of assistance in securing the tiles. The punching of tabs 103 leaves holes 104 in metal strips 101. These holes 104 can be used to secure pre-formed tiles to the interior of a reactor surface in place of the monolithic material.

Unfortunately, state of the art linings and the related techniques suffer from a number of drawbacks. These drawbacks include a relatively low mechanical stability and they often require very thick and heavy walls in order to provide the properties necessary to protect the reactor components. Another disadvantage of these prior art linings is the fact that it is generally difficult to remove individual elements or lining sections easily or non-destructively for replacement.

Finally, these prior art linings often are incapable of satisfying the ceramic property requirements associated with increasingly severe processes that result in ever increasing thermal and mechanical loads and stresses.

SUMMARY OF THE INVENTION

What is therefore needed is an anchoring system that will securely hold tiles to the substrate, while at the same time being easy to install and preferably being able to be retrofitted with existing refractory linings, including those with existing mesh.

One object of the present invention is to provide a tile for use in refinery process units, reactors and other furnace-like equipment that may be easily affixed to a substrate.

Another object is to provide a tile for use in refinery process units, reactors and other furnace-like equipment that is capable of remaining affixed to the substrate despite being exposed to a severe environment.

These and other objects will become apparent from the detailed description of the preferred forms set out below and now summarized as follows. The present invention employs individual tiles to form the reactor lining and to provide the ceramic properties that are required by a broad range of processes. The tiles forming the ceramic lining of the present invention are mounted into a hexagonal mesh or other abutment. Preformed tiles according to the teachings of the present invention have an advantage over the present in-situ-formed monolithic linings in that they can be made much more durable than present linings, as well as being more easily replaced, in whole or in part, over a continuous lining.

Further, problems arising in the mounting of tiles to form an internal refractory surface are addressed according to the present invention. Unreliable mounting systems in the prior art which allow ingress of particulate materials (catalyst or other) between or beneath tiles, lead to quicker degradation of the refractory lining, resulting in poor performance, downtime or property damage. Typically, in a room-temperature application, tiles are cemented or anchored via simple mechanical attachment to a substrate. Where elevated temperatures are involved, the ceramic tile become loose or form gaps between them due to reversible thermal expansion differences between the tile and the metal substrate. Typically, ceramics have half or less reversible thermal expansion as compared to stainless steels. If particulate materials are present of sufficiently small size, as is the case in FCCU's, they will become lodged between and behind the tiles. When the unit subsequently cools for any reason, reversible thermal expansion dictates that the tile return to the original size. The trapped particulate material prevents this from happening, setting up powerful stresses in the tile, often causing failure of the tile itself or failure of the attachment.

The present invention allows for tiles to be placed into the same hexagonal arrangement of mesh now commonly used in cyclones, and at the same time limits the deleterious effects of particulate ingress.

A preferred form of the tile for use in refinery process units, reactors and other furnace-like equipment is intended to accomplish at least one or more of the aforementioned objects according to the present teachings. One such form includes a tile for use in reactors and other furnace like equipment wherein the tile has an embedded locating rod that, when properly inserted into place, will laterally deploy into one or more punch holes 104 and secure the tile into place. In a refinement of this form, the tile is formed to include a gap that accepts a locating rod from an abutting tile.

In one form of this invention, a pin is driven into the top surface of the tile and forces at least one locating rod into a gap. In a refinement of this form, the threaded pin or screw is constructed of the same material as the tile surface and locks into place with a minimal seam on the tile surface.

In another form, the tile includes an embedded cam mechanism which, when turned, forces at least one locating rod into a gap. In a refinement of this form, the screw is constructed of the same material as the tile surface and locks into place with a minimal seam in the tile surface In still another form, the tile has at least one embedded locating rod that is forced out and into a gap due to the insertion of a liquid material into a cavity in the tile. In this embodiment, the liquid material hardens into a refractory solid once the locating rod is in place.

BRIEF DESCRIPTION OF THE DRAWINGS

The present invention will now be described in more detail with reference to preferred forms of the invention, given only by way of example, and with reference to the accompanying drawings, in which.

DETAILED DESCRIPTION OF THE INVENTION

Reference is now made to the forms depicted in FIGS. 1 through 8 wherein like numerals refer to like elements.

Surfaces that are subject to high levels of erosion, wear, corrosive elements, high temperatures and other such conditions need to be protected with materials that are resistant to such an environment. Refinery process units, such as fluid catalytic cracking units (FCCU's), furnaces and other types of equipment, hereinafter referred to generically as "reactors," are types of such equipment having a need for such linings. Although there are other kinds of equipment that equally have a need for resistant linings, herein FCCU's are used an exemplary embodiment of such equipment. As such, the teachings of the present invention should not be viewed to be limited to linings only for the particular equipment described in the examples of the following description. Instead, it should be understood that the invention described herein is limited only to what is claimed in the claims included herewith.

More reliable methods of mounting tiles to a refractory lining using locating rods embedded in a tile are now described. When a tile is in proper position, locating rods, as described below, are mechanically forced, laterally, into a gap. This gap may be a portion of the hexagonal mesh of the prior art, gaps in other structural devices of any shape which can cover area, such as triangles or rectangles, or even another adjacent tile. The locating rods may then be secured into position.

Figure 1:
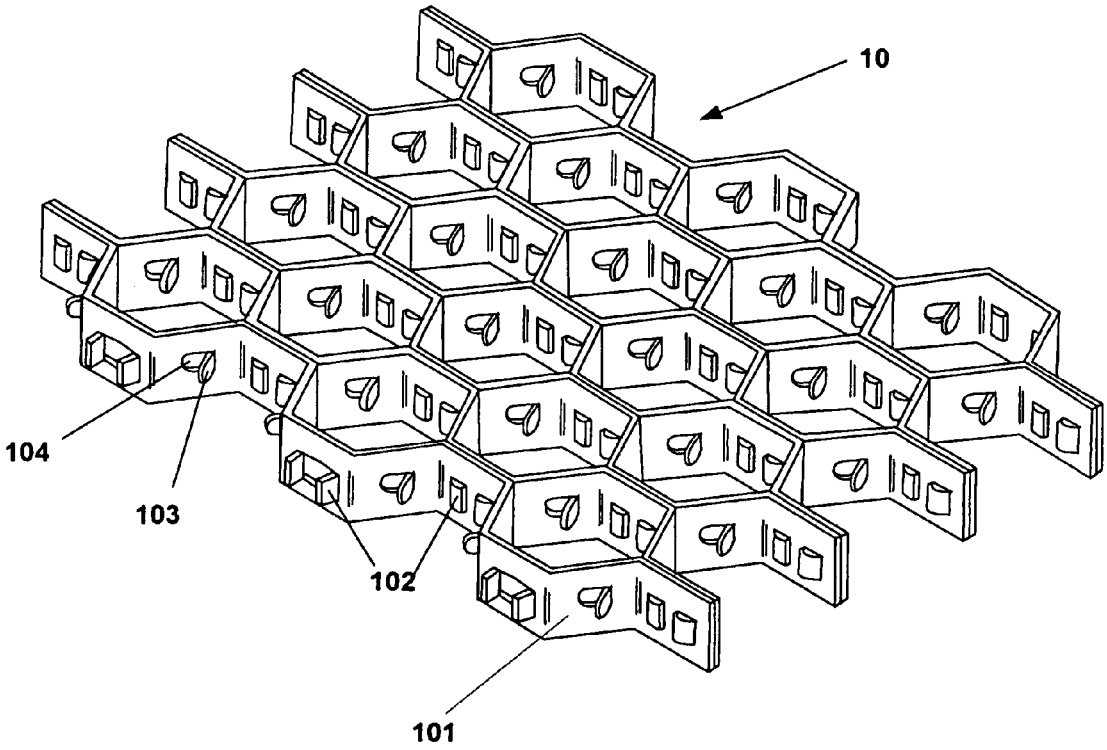
Prior Art Figure 1
FIG. 1 illustrates a typical hexagon metal mesh covering utilized in the prior art to contain monolithic materials in the hexagonal cells.
Figure 2:
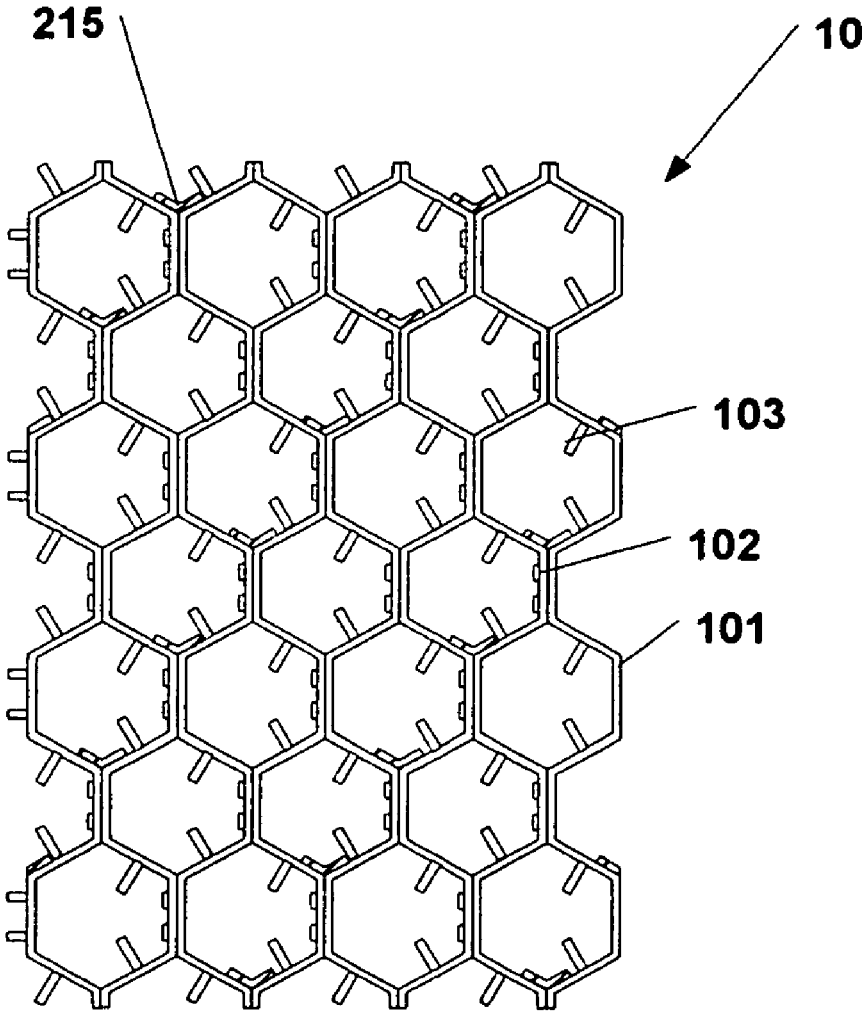
Prior Art Figure 2
FIG. 2 is a top view of the hexmetal mesh as used in the prior art to secure monolithic materials to the substrate material.
Figure 3:
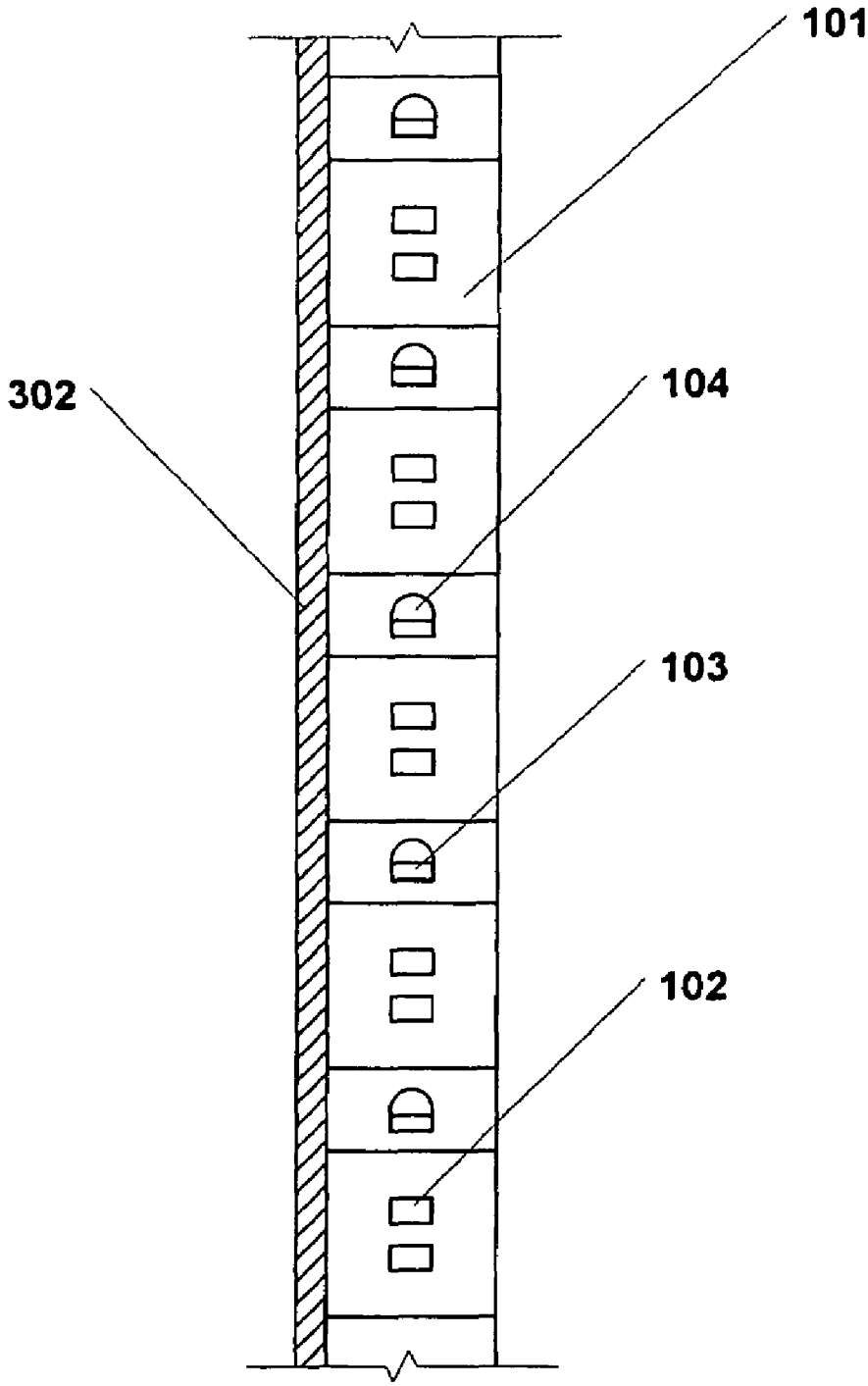
Prior Art Figure 3
FIG. 3 is a sectional view showing hexmetal mesh against substrate material as formed in connection with prior art attachment methodologies.
Figure 4A:
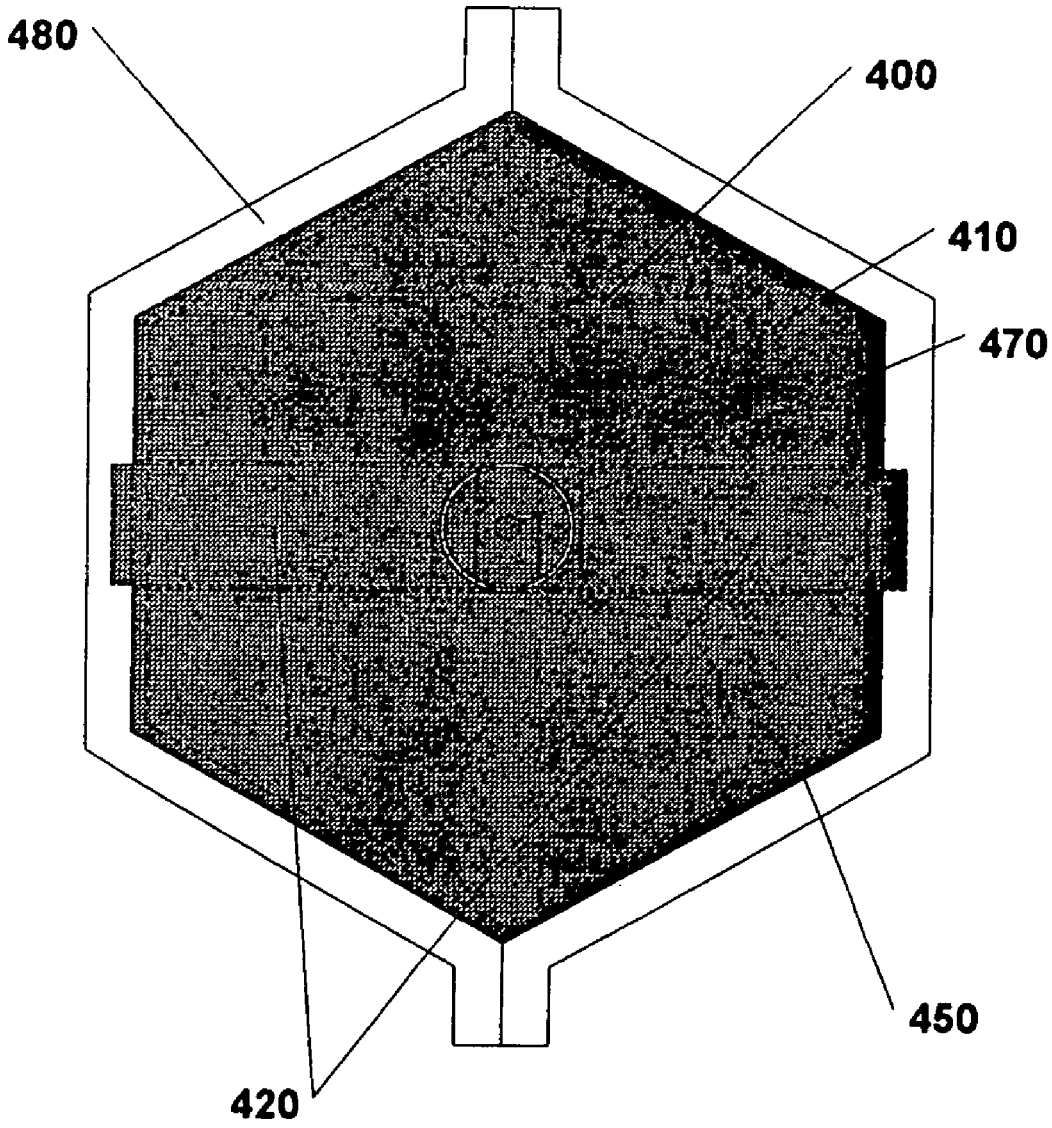
FIGS. 4A and 4B represent a top view and sectional view, respectively, of a tile fastened to a substrate according to a first embodiment of the present invention.
Figure 4B:
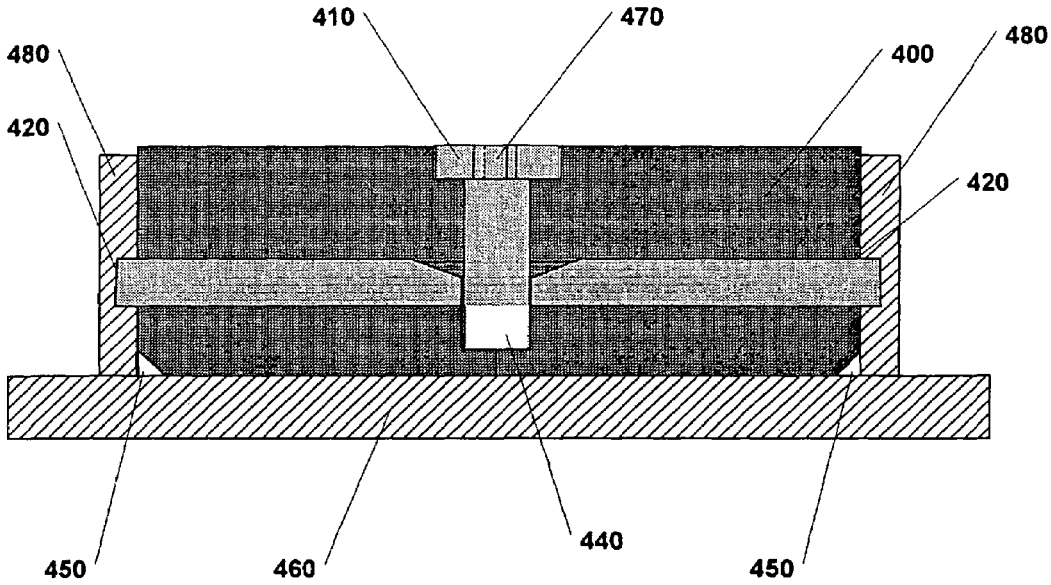

A detailed description of each of the embodiments is now provided. FIGS. 4A and 4B show an embodiment of the current invention where a threaded retaining pin or screw 410, when inserted into a tile 400, will force a pair of locating rods 420 into a gap of a pre-existing mesh or other gap in hexmetal structure 10 such as, for example, the gap 104 formed by the punch out of tabs 103 shown in FIG. 1.

Tile 400 has two locating rods 420 laterally embedded therein. Threaded pin or screw 410 may be forced into a space inside tile 400, and as a result, locating rods 420 are forced outwards. Threaded pin or screw 410 is locked in place by the threaded portion 440 of tile 400 accepting the end of pin 410. FIG. 4B shows a fully inserted pin 410 with locating rods 420 forced into a gap, such as maybe present in a wall 480 of a mesh structure, another type of structure or in an abutting tile. In linings that have a mesh covering, locating rods 420 may be designed to lock into the mesh, without the need for retaining tabs. Preferably the head of pin 410 is constructed of the same material as the facing of tile 400, and forms a relatively seamless joint when inserted into place. Tile 400 preferably contains a chamfered bottom edge 450, which allows room for the weld holding the structure containing the gap to the substrate 460.

The tile 400 is secured in place as a result of threaded screw 410 protruding into a matching threaded section 440 of tile 400 wherein the matching threaded section 440 is designed to receive the end portion of threaded pin or screw 410. The pin or screw 410 contains a recessed cavity 470 for the insertion of a tool to rotate the screw. The recess may be compatible with any of a number of tools, for example, Allen wrench, star tool or Phillips head screwdriver.

Figure 5A:
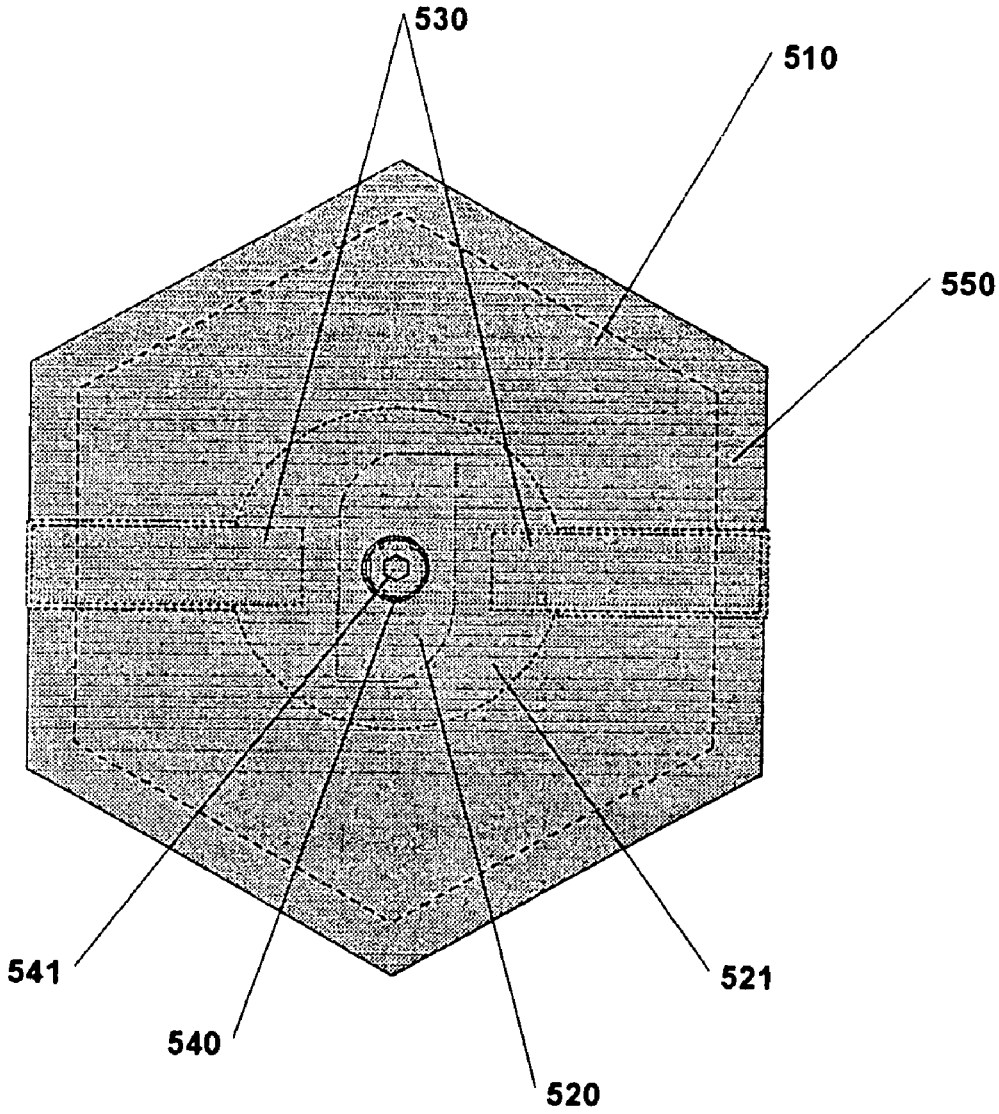
FIGS. 5A and 5B represent a top view and sectional view, respectively, of a tile fastened to a substrate according to a second embodiment of the present invention.
Figure 5B:
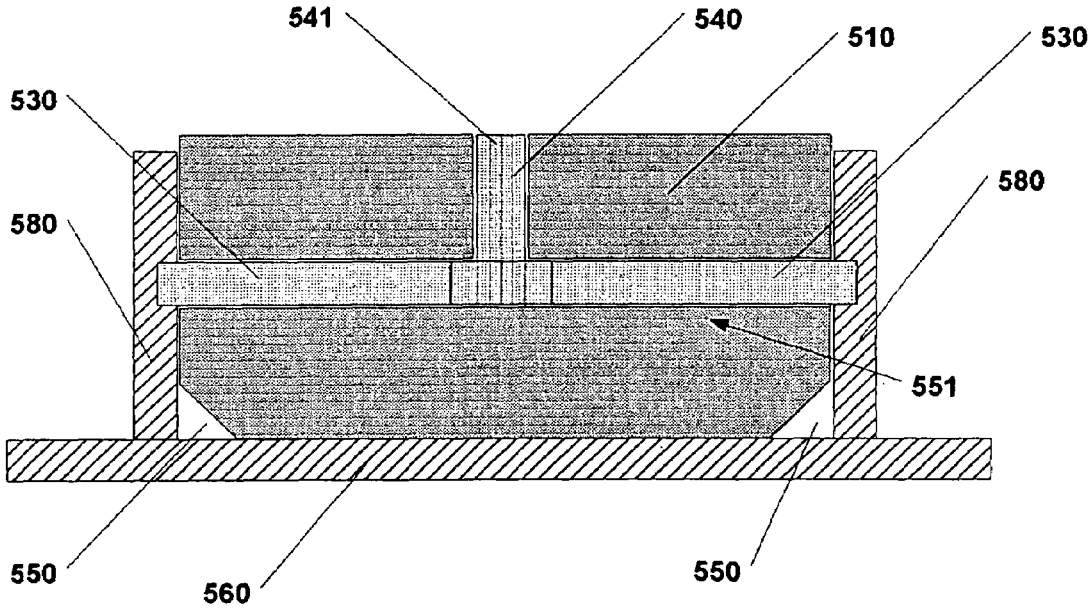

FIGS. 5A and 5B illustrate another embodiment of the invention wherein a rotating locking cam 520 within tile 510 locks locating rods 530 into a gap within the wall 580 of hexmetal mesh 10 (which again may be a punch hole 104 in an existing hexmetal mesh 10 or some other gap in a supporting material) by applying a ¼ turn to center spindle 540. Center spindle 540 causes rotating locking cam 520 to rotate when center spindle 540 itself is rotated an equivalent amount. When rotating locking cam 520 is rotated ¼ turn, it becomes longer in the lateral direction of the channel containing locating rods 530 so as to force locating rods 530 in a direction away from rotating locking cam 520 and into the gap in the wall 580 of hexmetal structure 10 or other abutment. Cam 520 itself is preferably locked into place by means of resin or mortar placed through an injection port 541. Details of one possible configuration of the rotating cam 520, locating rods 530 and center spindle 540 are shown in FIG. 5A. In this instance, rotating cam 520 contains a hexagonal central cavity into which a matching hexagonal end of the center spindle 540 fits, thereby allowing rotation of the spindle 540 and cam 520. The injection port itself 541 is shown as a hexagonal cavity enabling the insertion of an Allen wrench or other tool, as desired, to turn both the spindle 540 and cam 520. Tile 510 preferably contains a chamfered bottom edge 550, which allows room for the weld holding the structure 580 containing the gap to the substrate 560.

Figure 6A:
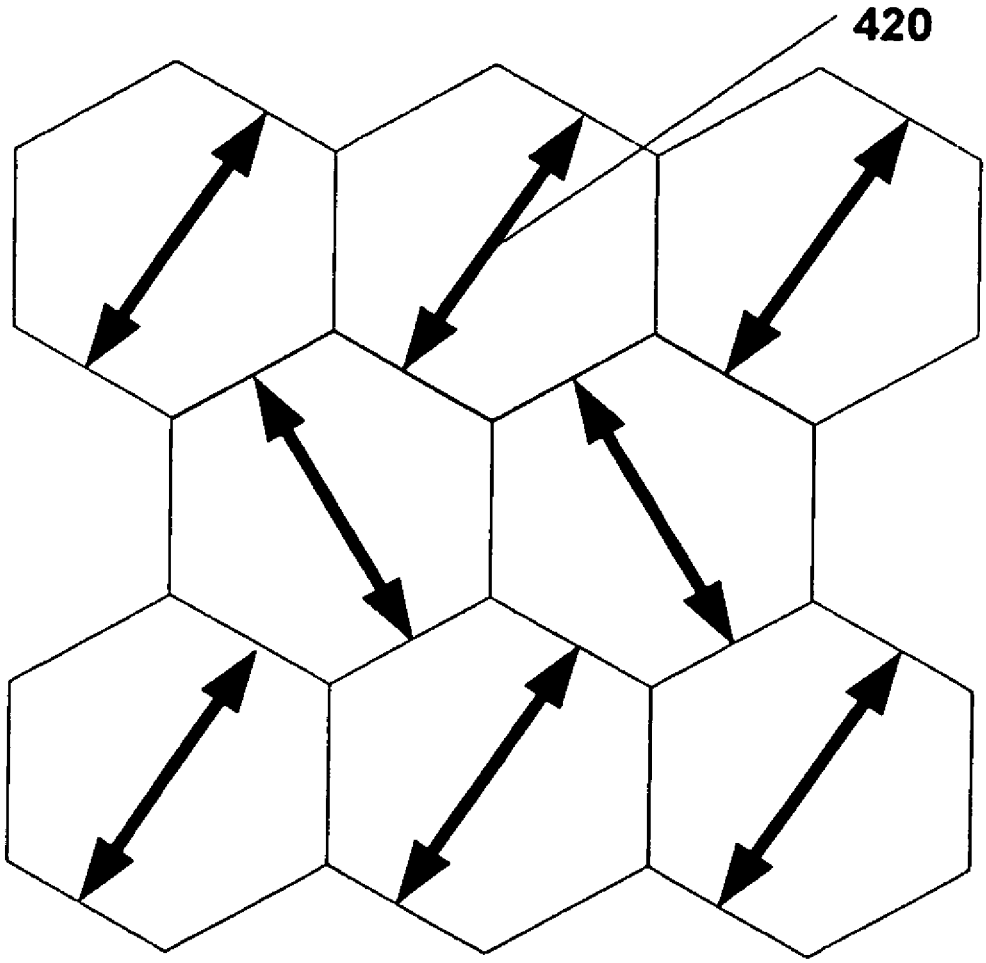
FIGS. 6A and 6B illustrate the preferred orientation for locating rods according to the first and second embodiments of the present invention, respectively.
Figure 6B:
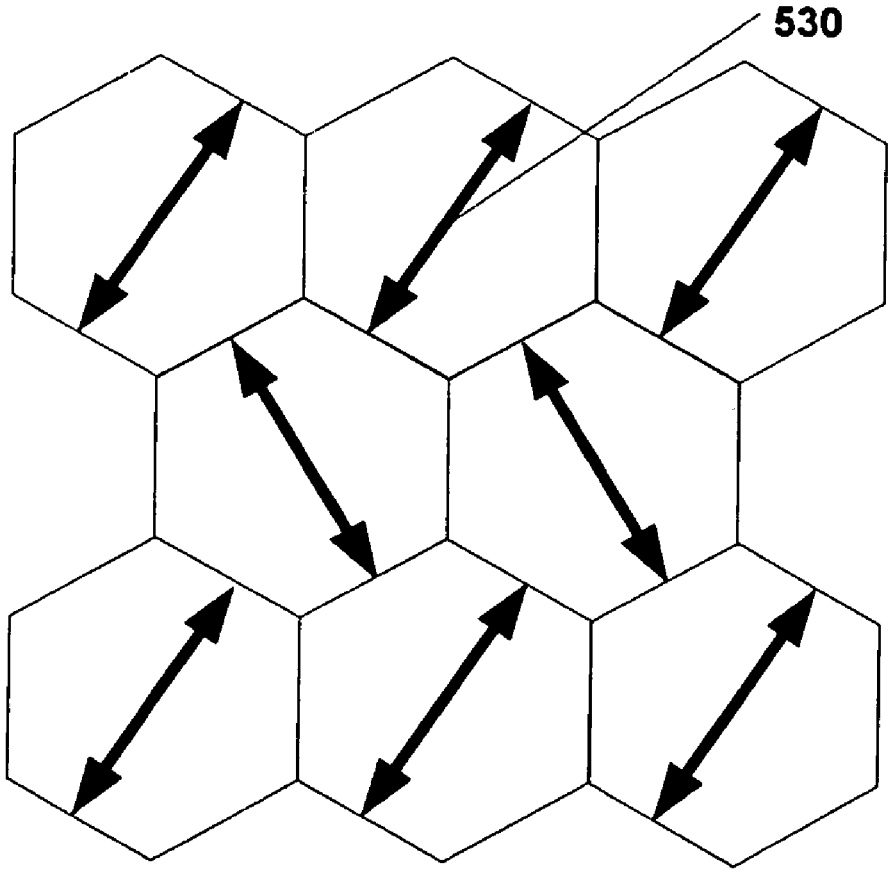

FIGS. 6A and 6B show the preferred orientation of locating rods 420 and 530, respectively among adjacent tile for the embodiments of FIGS. 4 and 5, respectively. Hexagonal shapes for the supporting cells are shown, although the same mechanisms work for any shape suited to covering areas, such as triangles or rectangles. Since the prior art utilizes hexagonal mesh welded to the substrate, the examples given can be utilized in the existing mesh and can abut installations of the prior art. As can be seen from FIGS.

6A and 6B, the preferred arrangement provides an alternating positioning of the locating rods 420 and 530 such that only a single locating rod 420 or 530, as applicable, is placed within each cell wall. Although the locating rods and cavities in abutments or hexmetal may be of a large range of shapes, the following is given as an example of a size compatible with the current art. The locating rods may be 5 mm by 10 mm in cross-section and 25 mm long.

Figure 7A:
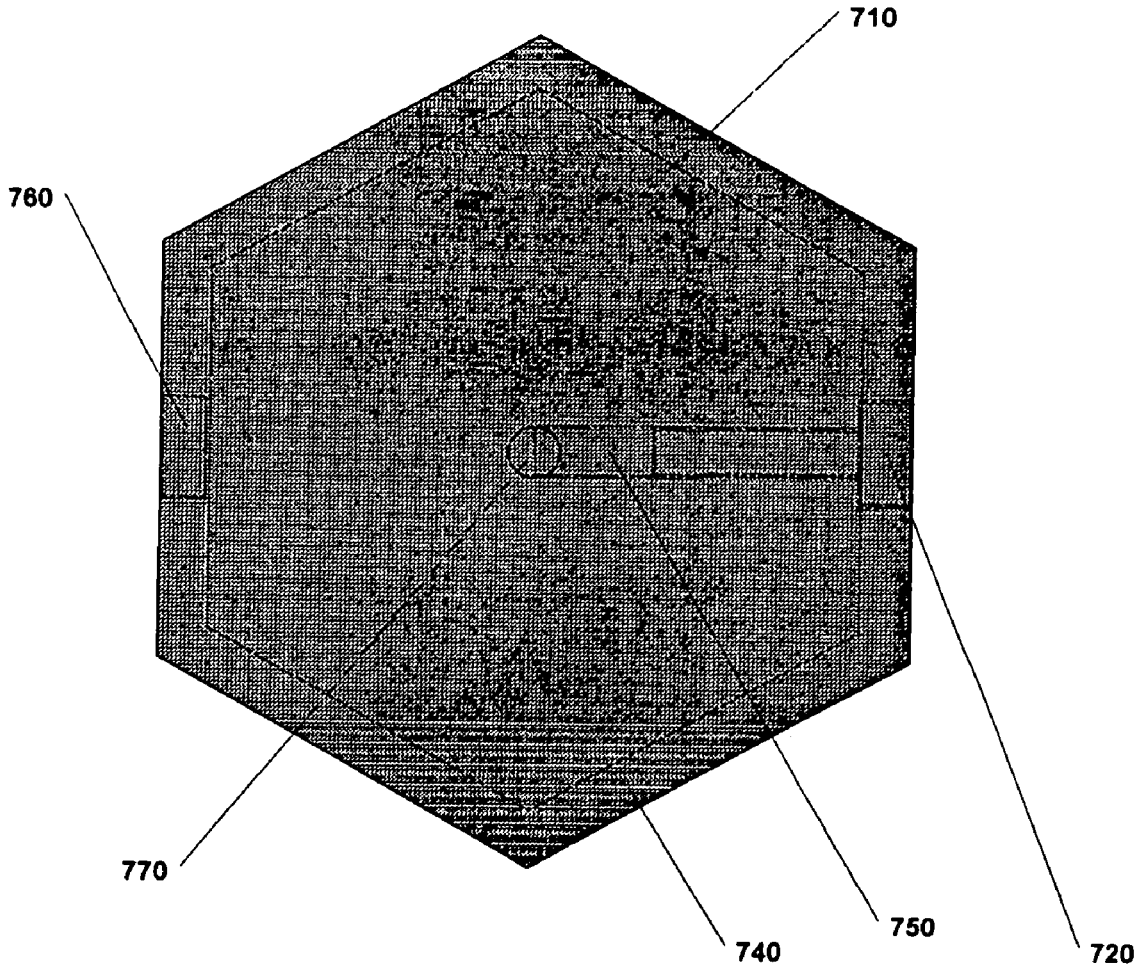
FIGS. 7A and 7B represent a top view and sectional view, respectively, of a tile fastened to a substrate according to a third embodiment of the present invention.
Figure 7B:
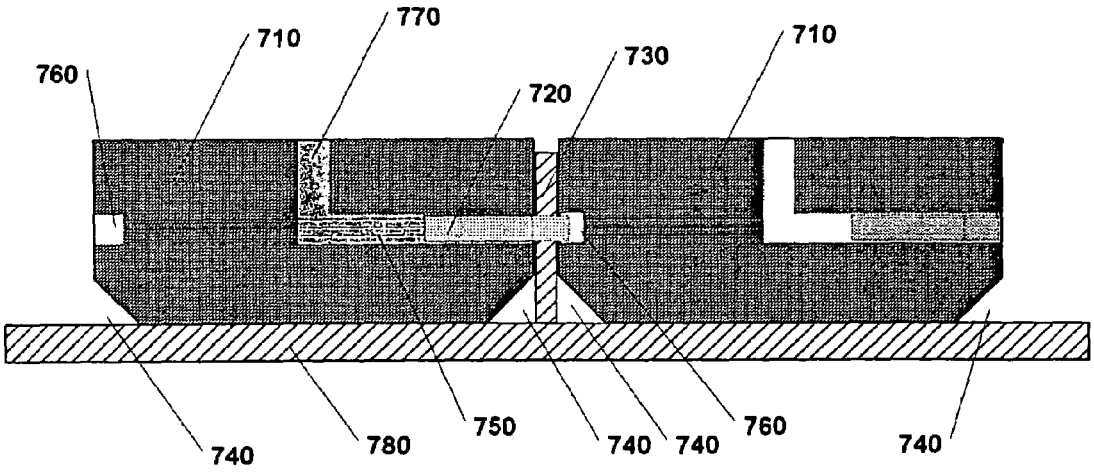

A preferred form using only a single locating rod 720 per tile is shown in FIGS. 7A and 7B. Locating rod 720 in this embodiment adjoins a recess or cavity 750 in tile 710. When the cavity 750 is filled by liquid under pressure through injection port 770, the locating rod 720 is forced outwards into a gap in an abutting structure 730. The material that fills the cavity 750 and forces locating rod 720 out and into the gap may be one of a variety of materials, but is preferably a mortar or resin-like material that will harden, locking tile 710 into position. Tile 710 also contains a second port 760 into which an adjacent tile can be locked in addition to or instead of a mesh or other substrate. As mentioned for the forms presented hereinabove, the locating rods 720 may extend through the gap and into other tiles or directly into other tiles without a separately abutting structure. Tile 710 preferably contains a chamfered bottom edge 740, which allows room for the weld holding the structure 730 containing the gap to the substrate 780.

To be compatible with current art using hexmetal mesh, the locating rod 720 may be, for example 25 mm long with a rod diameter of 5 mm and a rectangular cross-section head of 5 mm by 10 mm. The depth of the rectangular head may be 5 mm to 10 mm, for example.

Figure 8:
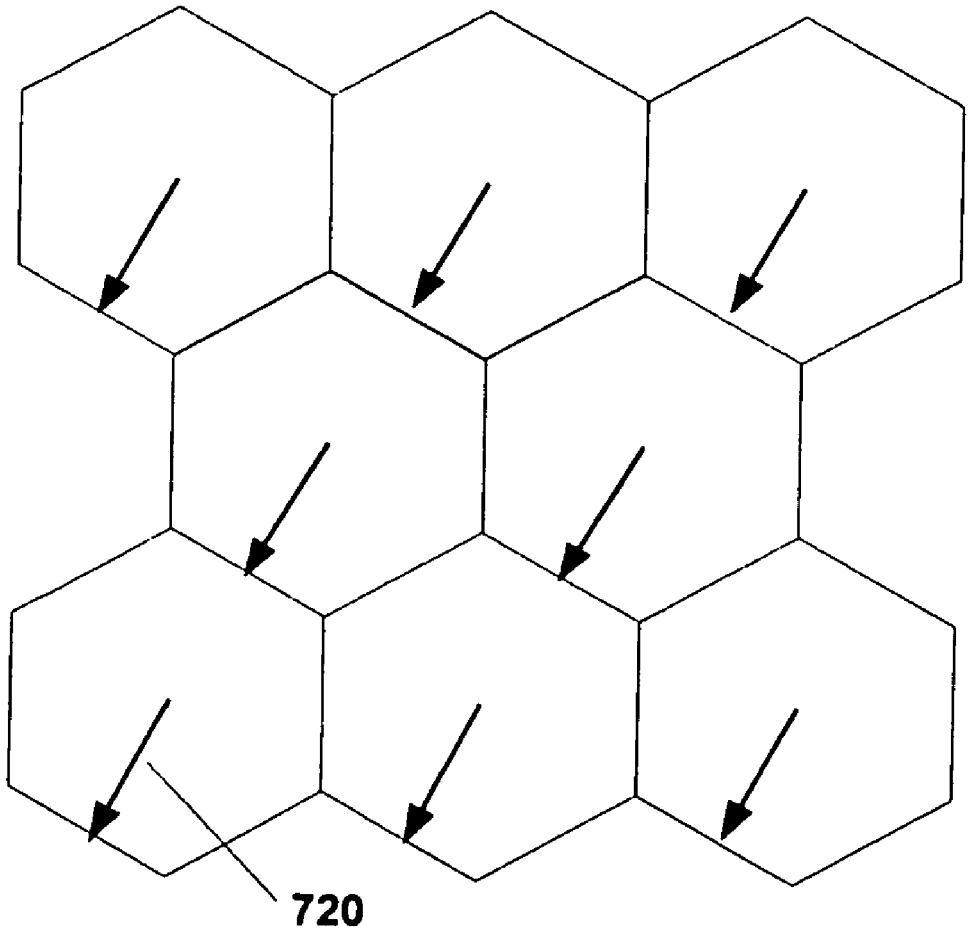
FIG. 8 illustrates shows the preferred orientation for locating rods according to the third embodiment of the present invention

In a preferred embodiment the tiles 710 in the embodiment of FIGS. 7A and 7B are arranged so that the locating rods 720 interlock with adjoining tiles in a linear pattern, as shown in FIG. 8.

Locating rods for all embodiments may be constructed of nearly any rigid, corrosive resistant material. Preferred materials, however, include pure ceramics, pure metals or mixtures of each.

Although the retaining tabs 103 in available hexmetal constructs are efficient for use with prior art, in-situ ceramics, they are generally not utilized in connection with the structures of the present invention, which requires the rapid and secure placement of tiles. The tabs 103, useful to secure monolithic refractory when rammed in-situ, generally interfere with the insertion of tiles into the hexmetal 10 when preformed tiles are used as the ceramic material. The punch holes 104 which are created as a result of forming the tabs 103, however, may be utilized according to the teachings of the present invention as described above.

While the preferred forms have been illustrated and described in detail in the drawings and foregoing description, they are illustrative and not restrictive in character. All changes and modifications that come within the scope of the preferred forms are desired to be protected.

What is claimed is:

1. A surface for lining a substrate material, comprising:

at least one tile having a wear resistant face a mesh structure;

each of said at least one tile having at least one passageway extending through a portion of the tile;

each of said at least one tile having at least one locating rod located within each of the at least one passageway, said at least one locating rod being selectively deployable from a retracted position located entirely within the tile to an extended position such that at least a portion of each locating rod laterally extends outside of said at least one tile and into an opening, wherein said opening is located in the mesh structure;

wherein said at least one tile is held in place by said at least one locating rod extending into said opening when said at least one locating rod is located in the extended position.

2. The surface according to claim 1, wherein said mesh structure is hexagonal mesh and said mesh structure is welded to a substrate material in at least one location.

3. The surface according to claim 1, wherein said at least one tile further comprises a pin and a cam, said pin and cam being interconnected so as to rotate together.

4. The surface according to claim 3 wherein said cam causes said at least one locating rod to deploy to the extended position.

5. The surface according to claim 3 wherein each of said tiles contains two locating rods aligned laterally with one another.

6. The surface according to claim 1 wherein each of said tiles contains two locating rods aligned laterally with one another.

7. The surface according to claim 2 wherein said tiles are arranged such that only a single locating rod is selectively deployable into each hexmetal cell wall.

8. A tile for lining a surface of a substrate material comprising:

a tile body having at least one at least one passageway extending through a portion of the tile body;

at least one locating rod located within the at least one passageway;

a rotatable cam; and a rotatable pin, said rotatable pin and said rotatable cam interconnected so as to rotate together;

wherein said at least one locating rod is selectively deployable between a retracted position such that the at least one locating rod is located entirely within the at least one passageway and an extended position such that at least a portion of the at least one locating rod extends outside of said tile body in response to rotation of said rotatable cam wherein said at least one locating rod extending into an opening in a mesh structure when said at least one locating rod is in the extended position.

9. The tile according to claim 8, wherein the head of said rotatable pin is constructed of the same material as the facing of said tile.

10. The tile according to claim 8, wherein said tile comprises two locating rods, said locating rods being aligned laterally.

11. A tile for lining a surface of a substrate material comprising:

a tile body having at least one passageway extending through a portion of the tile body;

at least one locating rod located within the at least one passageway;

a rotatable cam; and a center spindle, said center spindle and said rotatable cam interconnected so as to rotate together;

wherein said at least one locating rod is selectively deployable between a retracted position such that the at least one locating rod is located entirely within the at least one passageway and an extended position such that at least a portion of the at least one locating rod extends outside of said tile body in response to rotation of said rotatable cam, wherein said at least one locating rod extending into an opening in a mesh structure when said at least one locating rod is in the extended position.

12. The tile according to claim 11, wherein said tile comprises two locating rods, said locating rods being aligned laterally.

* * * * *